US007145579B2

(12) United States Patent
Arai et al.

(10) Patent No.: US 7,145,579 B2
(45) Date of Patent: Dec. 5, 2006

(54) DISPLAY APPARATUS

(75) Inventors: Yutaka Arai, Atsugi (JP); Masatoshi Abe, Odawara (JP)

(73) Assignee: Nec-Mitsubishi Electric Visual Systems Corporation, Tokyo (JP)

( * ) Notice: Subject to any disclaimer, the term of this patent is extended or adjusted under 35 U.S.C. 154(b) by 396 days.

(21) Appl. No.: 10/336,396

(22) Filed: Jan. 3, 2003

(65) Prior Publication Data

US 2003/0128185 A1 Jul. 10, 2003

(30) Foreign Application Priority Data

Jan. 7, 2002 (JP) ..... 2002-000677

(51) Int. Cl.
*G09G 5/10* (2006.01)
*G09G 5/00* (2006.01)

(52) U.S. Cl. ..... 345/690; 345/691; 345/213

(58) Field of Classification Search ..... 345/690, 345/691, 213; 386/33
See application file for complete search history.

(56) References Cited

U.S. PATENT DOCUMENTS

| | | | | |
|---|---|---|---|---|
| 5,576,837 | A * | 11/1996 | Strolle et al. | 386/33 |
| 5,808,701 | A | 9/1998 | Lee | |
| 6,498,617 | B1 * | 12/2002 | Ishida et al. | 347/252 |
| 6,621,480 | B1 * | 9/2003 | Morita | 345/213 |
| 6,628,276 | B1 * | 9/2003 | Elliott | 345/213 |

FOREIGN PATENT DOCUMENTS

| | | |
|---|---|---|
| EP | 0 296 602 A1 | 12/1988 |
| EP | 0 430 174 A2 | 6/1991 |
| JP | 61-203786 | 9/1986 |
| JP | 61-260090 | 11/1986 |
| JP | 64-032587 | 2/1989 |
| JP | 01-138875 | 5/1989 |
| JP | 01-188186 | 7/1989 |
| JP | 03-166890 | 7/1991 |
| JP | 06-102835 | 4/1994 |
| JP | 07-095048 | 4/1995 |
| JP | 07-319420 | 12/1995 |
| JP | 10-013853 | 1/1998 |
| JP | 11-224073 | 8/1999 |
| JP | 2000-056752 | 2/2000 |
| JP | 2000-175210 | 6/2000 |

* cited by examiner

*Primary Examiner*—Kee M. Tung
*Assistant Examiner*—Chante Harrison
(74) *Attorney, Agent, or Firm*—Scully, Scott, Murphy & Presser, P.C.

(57) ABSTRACT

In a display apparatus that receives and then displays R, G, B signals transmitted from a computer via a cable, when correcting phase differences between the respective signals that are generated while the signals are being transmitted, the phase correction amount can be reduced and phase adjustment performed automatically by a simple circuit structure. In a phase detection section, the phases of R, G, B signals input from a PC relative to a horizontal synchronization signal HD are detected, and based on the result of these detections, a calculation section 11 determines which color signal from the R, G, B signals has the greatest delay relative to the horizontal synchronization signal HD, and also determines the phase differences of the remaining two signals relative to the most delayed signal. A control section then performs control such that the delay amount of the delay circuit of the most delayed color signal out of the delay circuits is set to zero, and the delay amounts of the delay circuits of the remaining two color signals are controlled in accordance with the above phase differences.

17 Claims, 5 Drawing Sheets

INPUT IMAGE SIGNALS

PHASE CORRECTED IMAGE SIGNALS

POSITION CORRECTED INPUT IMAGE SIGNALS

DISPLAY APPARATUS

BACKGROUND OF THE INVENTION

1. Field of the Invention

The present invention relates to a display apparatus that is favorably used in a display system that displays on a liquid crystal element or the like color signals such as R, G, B signals output from a PC.

2. Description of the Related Art

In a conventional display system in which color signals such as R (red), G (green), and B (blue) signals generated by a personal computer (PC) are transmitted to a display apparatus via a cable, there are many cases in which the display apparatus is located at a considerable distance from the PC, resulting in a long cable needing to be used. If the signal transmission distance is lengthened like this, the problem arises of phase differences being generated between the R, G, B signals.

In particular, in the case of a high resolution display apparatus that uses a liquid crystal display element, even if there is only a slight discrepancy between the phases of the R, G, and B signals, failures sometimes occur such as portions of the ends of displayed characters becoming colored. In some modern systems there are even cases when the PC and the display apparatus may be located as much as 300 meters away from each other, so that the above problem of the phase difference generation becomes an extremely serious one.

In order to solve this problem a method has been employed in which the phases are manually adjusted for each of the R, G, B signals.

However, in the method of adjusting the phases for each of the R, G, B signals, if, for example, a phase is delayed, there are cases in which a large phase correction of close to one cycle of the horizontal synchronization signals is necessary. Therefore, not only does the adjustment take time, but the further problem of an increased circuitry size arises. In addition, in the case of a multi-sync display apparatus in which a plurality of types of R, G, B signals each having different synchronization signals are selectively input, because the phase difference that needs to be corrected is different for each type of input signal, the problem arises that manual adjustment must be performed again every time the type of input signal changes.

The present invention was conceived in order to solve the above described problems, and it is an object thereof to provide a display apparatus capable of reducing a phase adjustment amount and automatically achieving a phase adjustment in a short time using a simple circuit structure.

SUMMARY OF THE INVENTION

In order to achieve the above object, the present invention is a display apparatus comprising: a plurality of delay means having variable delay amounts that delay each of a plurality of color signals; phase detection means that detects each phase in the plurality of color signals relative to a reference signal; calculation means that, based on a detection result by the detection means, determines which color signal from the plurality of color signals is delayed the most relative to the reference signal, and determines phase differences of other color signals relative to this color signal; and control means that controls a delay amount of a delay means of the color signal that is delayed the most such that the delay amount is a predetermined amount, and controls delay amounts of delay means of the other color signals in accordance with the phase differences of the other color signals.

According to the above structure, the phase detection means detects respective phases of a plurality of color signals such as R, G, B signals relative to a reference signal such as a horizontal synchronization signal, and, based on the result of this detection, the calculation means determines the color signal from among the plurality of color signals that is delayed the most relative to the reference signal, and also determines phase differences of the remaining color signals relative to the most delayed color signal. The control means controls a delay amount of the delay means of the color signal that is delayed the most such that this delay amount is a predetermined amount, and also controls the delay amounts of the delay means of the other color signals in accordance with the phase differences of the other color signals. As a result, it is possible to downsize the phase correction amount and simplify the circuit structure, and to perform phase adjustment automatically in a short period of time.

Accordingly, because a structure is employed in which the color signal having the largest delay is determined from the plurality of color signals, and the phase differences between this signal and the remaining color signals are determined, and the delay amounts of each color signal are controlled in accordance with these phase differences, it is possible to reduce the phase amount to be corrected and perform adjustment that removes the phase differences between each color signal. As a result, the size of the circuitry can be reduced and phase adjustment can be performed automatically in a short period of time. Moreover, it becomes possible to perform phase adjustment automatically in accordance with the type of input signal even when the present invention is used in a multi-sync display apparatus.

Furthermore, by employing a structure in which each delay circuit is formed by an analog signal delay circuit and a digital signal delay circuit, and performing analog control and digital control in combination, phase adjustment can be performed even more accurately.

DESCRIPTION OF THE PREFERRED EMBODIMENTS

The embodiments of the present invention will now be described together with the drawings.

Figure 1:
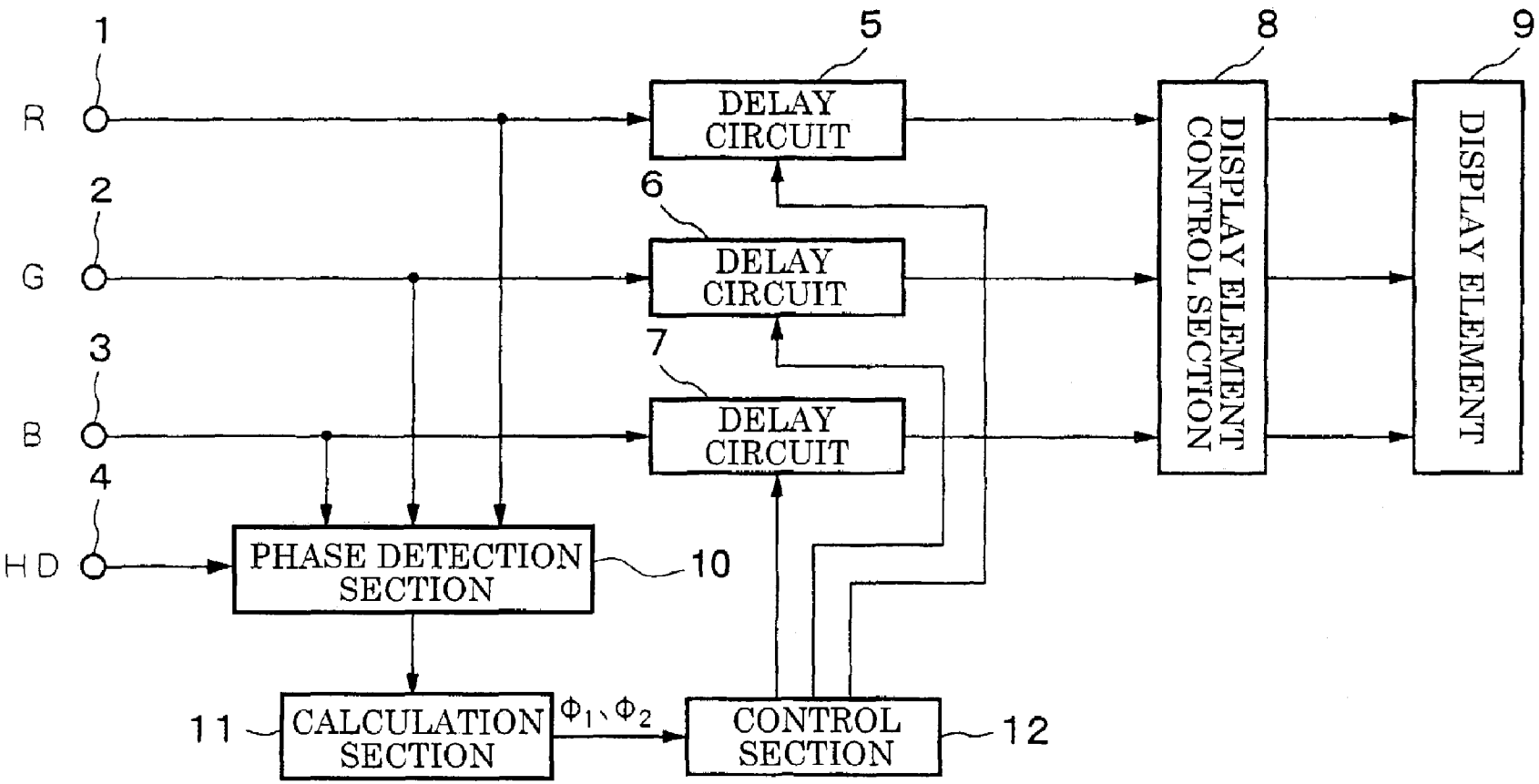
FIG. 1 is a block diagram showing a display apparatus according to the first embodiment of the present invention.

FIG. 1 is a block diagram showing the structure of the display apparatus according to the first embodiment of the present invention.

In FIG. 1, the symbol 1 indicates an input terminal that receives the input of R signals from a PC (not shown) serving as a signal source, the symbol 2 indicates an input terminal that receives the input of G signals also from a PC, and the symbol 3 indicates an input terminal that receives the input of B signals also from a PC. The symbol 4 indicates an input terminal that receives the input of horizontal synchronization signals HD also from a PC. The symbol 5 indicates a delay circuit having a variable delay amount that delays input R signals, the symbol 6 indicates a delay circuit having a variable delay amount that delays input G signals, and the symbol 7 indicates a delay circuit having a variable delay amount that delays input B signals. The symbol 8 indicates a display element control section that converts the delayed R, G, B signals into display signals of a predetermined format. The symbol 9 indicates a display element such as a liquid crystal display element that displays an image based on the converted display signals.

The symbol 10 indicates a phase detection section that detects a phase based on the horizontal synchronization signals HD of the input R, G, B signals as a reference. The symbol 11 indicates a calculation section that detects the most delayed signal relative to the horizontal synchronization signals HD based on a result of a detection by the phase detection section 10, and that determines phase differences $\phi 1$ and $\phi 2$ of the other two signals relative to the most delayed signal. The symbol 12 indicates a control section that controls the delay amount of the delay circuit of the most delayed signal from the delay circuits 5, 6, and 7 such that the delay amount matches a predetermined amount, and that also controls the delay amounts of the delay circuits of the other two signals respectively in accordance with $\phi 1$ and $\phi 2$.

Next, an operation using the above structure will be described.

In FIG. 1, R, G, B signals are input from a PC to the input terminals 1, 2, and 3, and horizontal synchronization signals HD are input to the input terminal 4. The input R, G, B signals are then input into the delay circuits 5, 6, and 7. In addition to this, the phases of the input R, G, B signals that are based respectively on the horizontal synchronization signals HD are detected in the phase detection section 10. The calculation section 11 detects the most delayed signal relative to the horizontal synchronization signals HD based on the detection result by the phase detection section 10, and determines the phase differences $\phi 1$ and $\phi 2$ of the other two signals relative to the most delayed signal.

Next, the control section 12 controls the delay amount of the delay circuit of the most delayed signal from the delay circuits 5, 6, and 7 such that the delay amount matches a predetermined amount (for example, zero), and also controls the delay amounts of the delay circuits of the other two signals respectively to a size corresponding to $\phi 1$ and $\phi 2$.

For example, if it is assumed that the signals with the most delay relative to a horizontal synchronization signal HD are the G signals, then the delay amount of the delay circuit 6 of the G signals is set to zero, and the delay amount of the delay circuit 5 of the R signals is set to a size corresponding to $\phi 1$, while the delay amount of the delay circuit 7 of the B signals is set to a size corresponding to $\phi 2$.

According to the above operation, the phase difference between the R, G, B signals output from the respective delay circuits 5, 6, and 7 is removed. After these R, G, B signals with no phase difference are converted into display signals of a predetermined format by the display element control circuit 8, they are supplied to the display element 9 and an image is displayed. As a result, it is possible to display an image with no color misregistration. Moreover, even in the case of a multi-sync type of display apparatus, because phase detection is performed in the phase detection section 10 regardless of the type of input R, G, B signals, appropriate phase adjustment can be performed automatically regardless of the type of input signal.

Figure 2:
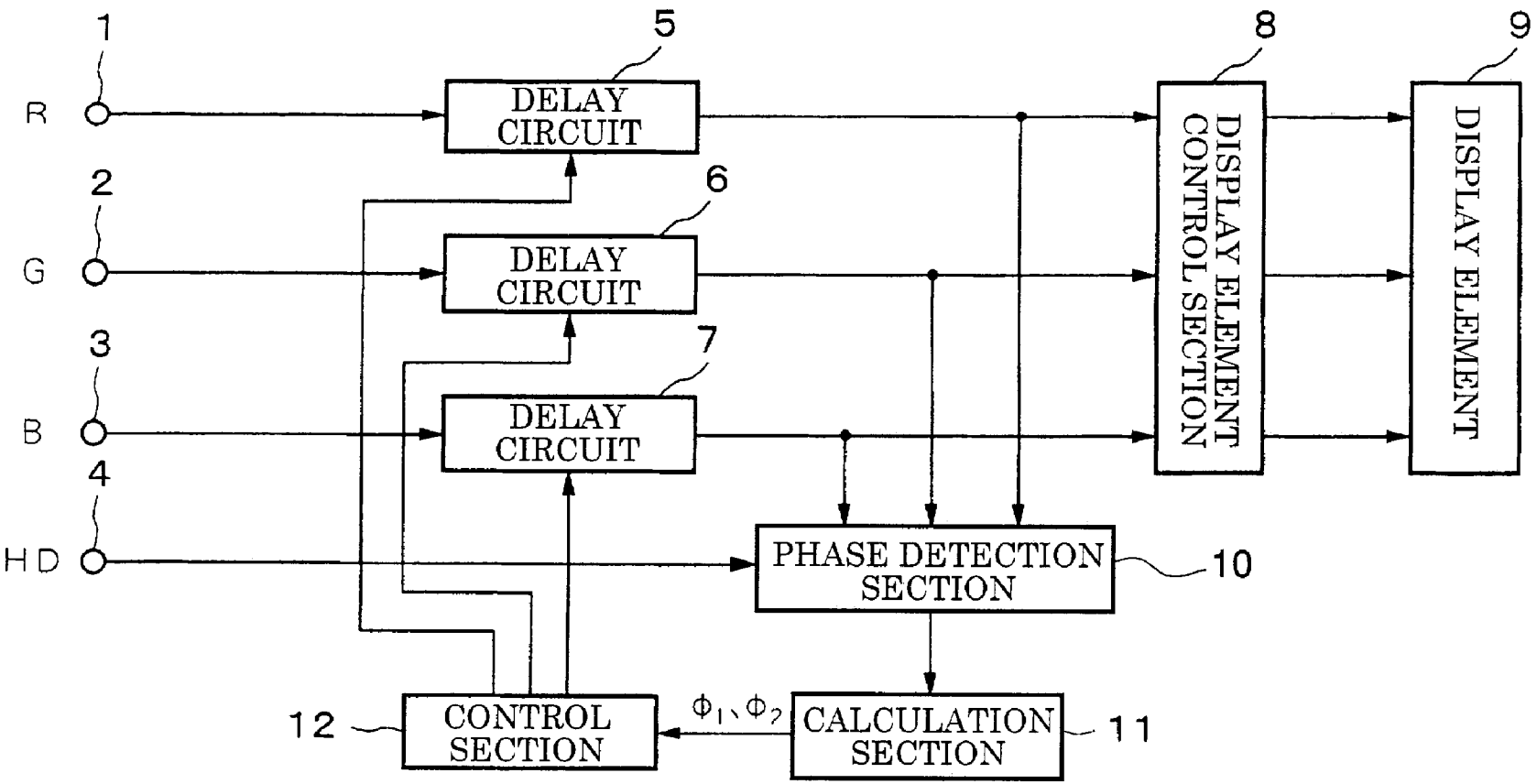
FIG. 2 is a block diagram showing a display apparatus according to the second embodiment of the present invention.

FIG. 2 is a block diagram showing the structure of the display apparatus according to the second embodiment of the present invention, and the same descriptive symbols are given to portions that correspond to portions in FIG. 1 and a description thereof is not repeated.

The above described first embodiment shown in FIG. 1 employs a feed forward control mode in which a phase detection section 10 is provided upstream from the delay circuits 5, 6, and 7, and the delay amount of each delay circuit is controlled by detecting the phases of the R, G, B signals input from the PC serving as a signal source. However, the present embodiment employs a feed back control mode in which, as is shown in FIG. 2, the delay amounts of the respective delay circuits 5, 6, and 7 are controlled with the phase detection section 10 provided downstream from the delay circuits 5, 6, and 7.

Next, the operation of the above structure will be described.

In an initial state, the delay amounts of the respective delay circuits 5, 6, and 7 are set to a predetermined amount (for example, zero), and in this state, firstly, the phase detection section 10 detects the respective phases of the R, G, B signals delayed by the respective delay circuits 5, 6, and 7 relative to a horizontal synchronization signal HD. The calculation section 11 detects the signal with the most delay relative to the horizontal synchronization signal HD based on the above phase detection result, and determines the phase differences $\phi 1$ and $\phi 2$ of the other two signals relative to the most delayed signal. Next, the control section 12 controls the delay amounts of the delay circuits of the other two signals such that the phase differences $\phi 1$ and $\phi 2$ of the above other two signals are zero.

For example, if it is assumed that the signals with the most delay relative to the horizontal synchronization signal HD are the G signals, then the delay amount of the delay circuit 6 of the G signals is set to zero, and the delay amount of the delay circuit 5 of the R signals is set to a size corresponding to $\phi 1$, while the delay amount of the delay circuit 7 of the B signals is set to a size corresponding to $\phi 2$.

Figure 3:
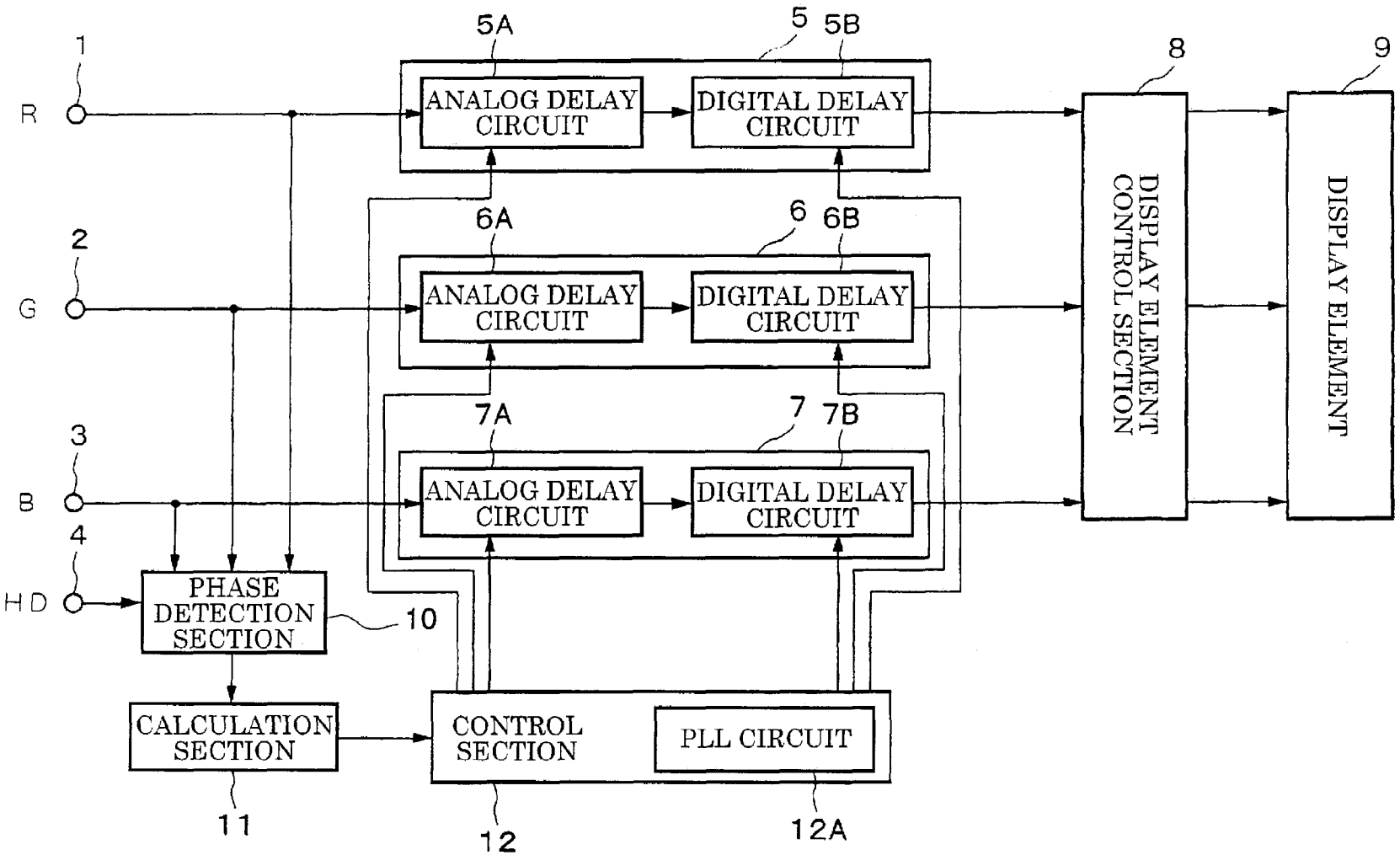
FIG. 3 is a block diagram showing a display apparatus according to the third embodiment of the present invention.

FIG. 3 is a block diagram showing the structure of the display apparatus according to the third embodiment of the present invention, and the same descriptive symbols are given to portions that correspond to portions in FIG. 1 and a description thereof is not repeated.

In the present embodiment, as is shown in FIG. 3, the delay circuit 5 is formed by an analog delay circuit 5A and a digital delay circuit 5B, the delay circuit 6 is formed by an analog delay circuit 6A and a digital delay circuit 6B, and the delay circuit 7 is formed by an analog delay circuit 7A and a digital delay circuit 7B.

The delay amounts of the analog delay circuits 5A, 6A, and 7A are analog controlled by the control section 12 as delay amounts of less than 1 dot (i.e., pixel). The delay amounts of the analog delay circuits 5B, 6B, and 7B are digitally controlled in 1 dot units based on dot clocks by the control section 12 as delay amounts of 1 dot or more. A PLL circuit 12A that generates dot clocks by operating on the basis of the horizontal synchronization circuits HD is provided in the control section 12.

In the present embodiment, the delay amounts of the R, G, B signals are analog controlled for small phase differences of less than 1 dot, while the delay amounts of the R, G, B signals are digitally controlled for large phase differences in 1 dot (pixel) units. By performing a combination of analog and digital control in this manner, it is possible to achieve more accurate phase correction.

Note that, in the second embodiment as well, by forming the respective delay circuits 5, 6, and 7 from analog delay circuits 5A, 6A, and 7A and digital delay circuits 5B, 6B, and 7B, in the same way as in the third embodiment, a structure can be achieved in which a combination of analog and digital control can be performed.

Figure 4:
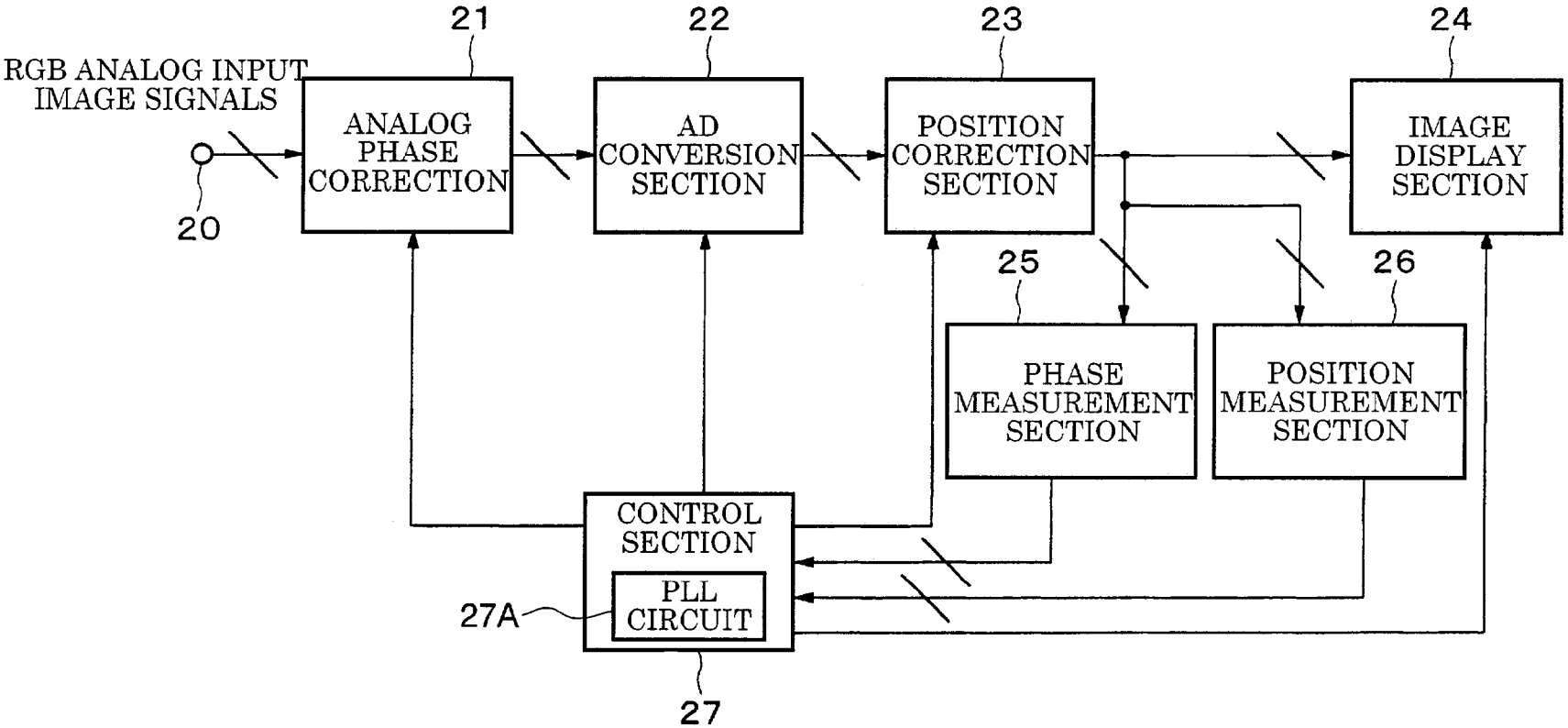
FIG. 4 is a block diagram showing a display apparatus according to the fourth embodiment of the present invention.

FIG. 4 is a block diagram showing the fourth embodiment of the present invention. The present embodiment is an example of when the above described analog control and digital control are performed.

In FIG. 4, the symbol 20 indicates an input terminal that receives the input in parallel of analog R signals, G signals, and B signals in the same way as in FIGS. 1 to 3. The symbol 21 indicates an analog phase correction section that corrects the respective phases of the R, G, B signals. The symbol 22 indicates an A/D conversion section that converts the phase corrected analog R, G, B signals respectively into digital R, G, B signals. The symbol 23 indicates a position correction section that corrects the dot unit phases (i.e., dot positions) of the converted digital R, G, B signals. The symbol 24 indicates an image display section that displays the position corrected R, G, B signals, and includes a display control section and a display element and the like.

The symbol 25 indicates a phase measurement section that measures the respective phases of the position corrected R, G, B signals. The symbol 26 indicates a position measurement section that detects the respective dot positions of the position corrected R, G, B signals. The symbol 27 indicates a control section that controls the analog phase correction section 21, the A/D conversion section 22, the position correction section 23, and the image display section 24 based on detections by the phase measurement section 25 and the position measurement section 26. The symbol 27A indicates a PLL circuit that generates dot clocks supplied to the A/D conversion section 22.

In this example, the phase measurement section 25 and the position measurement section 26 are positioned after the position correction section 23, however, it is to be understood that phase measurement section 25 and the position measurement section 26 may also be positioned between the A/D conversion section 22 and the position correction section 23. Alternatively, the phase measurement section 25 may be positioned between the A/D conversion section 22 and the position correction section 23 with the position measurement section 26 positioned after the position correction section 23, or the phase measurement section 25 may be positioned after the position correction section 23 with the position measurement section 26 positioned between the A/D conversion section 22 and the position correction section 23.

Next, the operation of the above structure will be described.

Figure 5A:
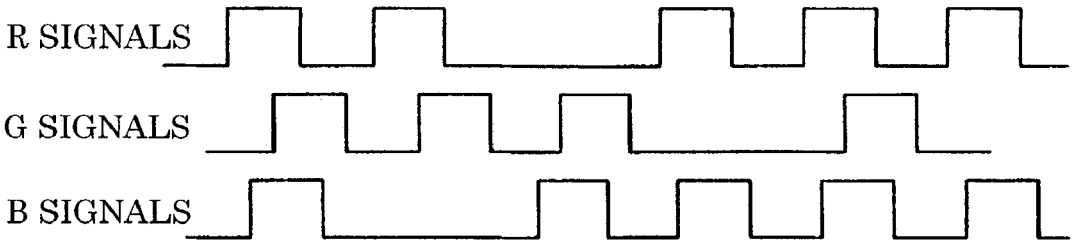
FIG. 5 is a timing chart showing the operation of FIG. 4.
Figure 5B:
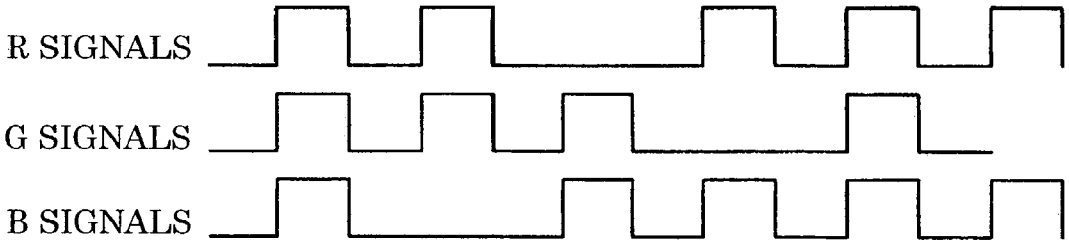
Figure 5C:
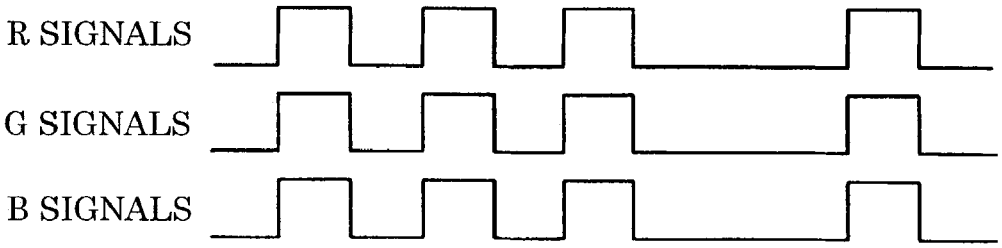

The analog R, G, B signals shown in FIG. 5(*a*) are input into the input terminal 20. As is shown in FIG. 5(*a*), there are discrepancies between the dot positions and phases of each of these R, G, B signals. The present embodiment enables these phase discrepancies and position discrepancies to be corrected. By correcting the phase discrepancies, as is shown in FIG. 5(*b*), phases of the R, G, B signals of less than 1 dot are removed. In addition, by correcting the position discrepancies, as is shown in FIG. 5(*c*), the positions of the R, G, B signals are aligned.

The A/D conversion section 22 receives the supply of dot clocks from the PLL circuit 27A and performs a sampling of the analog R, G, B signals, however, for a variety of reasons there are times when these clocks have problems with jittering. Therefore, the sampling points are optimized by selecting one phase when the width of each dot is divided, for example, into 32 phases so as to reduce the variations in the sample value caused by jittering. As a result, by dividing the output from the PLL circuit 27A into 32 and then selecting one of these, it becomes possible to adjust the dot clock phases in 32 levels. Note that in the A/D conversion section 22 the R, G, B signals are sampled using common dot clocks.

A description will firstly be given of the aforementioned phase correction.

Analog R, G, B signals input from the input terminal 20 undergo phase correction in the analog phase correction section 21, and are then converted into digital R, G, B signals by the A/D conversion section 22. These signals then undergo position correction in the position correction section 23, and are then displayed on the image display section 24. As part of the output of the position correction section 23, the phases of the R, G, B signals input into the phase measurement section 25 are detected respectively therein. The control section 27 sets the phases of the dot clocks supplied to the A/D conversion section 22 to match the signal with the most delayed phase from the R, G, B signals.

As a result, the control section 27 acquires the sampling data for the 32 phase portions of the respective dot clocks for the R, G, B signals, and based on the acquired data, determines the optimum values for the phases for each of the R, G, B signals. For example, the optimum value for the phase of the R signals may be phase 16 from among the dot clocks of the 32 phases, while in the same way the optimum value for the G signals may be phase 4, and in the same way the optimum value for the B signals may be phase 28. The control section 27 controls the PLL circuit 27A so that the dot clocks of the phase 28 that has the most delay are set for supply to the A/D conversion section 22.

Because it is only possible to set dot clocks of one phase in the A/D conversion section 22, in this state the optimum clock phase is set for the B signals, however, the clock phase is not set optimally for the R and G signals. Therefore, the control section 27 controls the analog phase correction section 21 so that the correction is made with the R signals delayed by an amount of 12 phases (i.e., =28−12) before the A/D conversion is performed, and the G signals delayed by an amount of 24 phases (i.e., =28−4) before the A/D conversion is performed. As a result, in the A/D conversion section 22, it is possible to optimize all the R, G, B signals as phase 28. Accordingly, as in FIG. 5(*b*), firstly, phase differences in the R, G, B signals of less than 1 dot are removed.

Next, the position correction will be described.

In this case as well, optimum values are determined individually for the positions of the R, G, B signals. In the position measurement section 26, the left end coordinates of the image region are detected for each of the R, G, B signals. For example, the left end coordinate for the R signal may be 200, the left end coordinate for the G signal may be 202, and the left end coordinate for the B signal may be 205. At this time, taking the B signal that has the most delay as a reference, the R signal is delayed by 5 dots, and the G signal is delayed by 3 dots. As a result, in the image display section 24, if the respective data is sampled at the coordinate 205 for each of the R, G, B signals, then it is possible, as in FIG. 5(*c*), for the positions to be aligned on a screen.

What is claimed is:

1. A display apparatus comprising:

a plurality of delay means having variable delay amounts that delay each of a plurality of color signals;

phase detection means that detects each phase in the plurality of color signals relative to a reference signal;

calculation means that, based on a detection result by the detection means, determines which color signal from the plurality of color signals is delayed the most relative to the reference signal, and determines phase differences of other color signals relative to this color signal; and control means that controls a delay amount of a delay means of the color signal that is delayed the most such that the delay amount is a predetermined amount, and controls delay amounts of delay means of the other color signals in accordance with the phase differences of the other color signals such that phase differences of the other color signals are removed, the delay means comprising:

analog delay means having a delay amount of less than one pixel; and digital delay means having a delay amount of one pixel or more, the control means performing analog control of the analog delay means and performing digital control in one pixel units of the digital control means.

2. The display apparatus according to claim 1, wherein the phase detection means detects phases of a plurality of color signals input from a signal source, and the control means performs control such that there is zero phase difference in outputs from each delay circuit.

3. The display apparatus according to claim 2, wherein the delay means comprises analog delay means having a delay amount of less than one pixel and digital delay means having a delay amount of one pixel or more, and the control means performs analog control of the analog delay means and performs digital control in one pixel units of the digital control means.

4. The display apparatus according to claim 3, wherein there is provided display means that displays each color signal delayed by the plurality of delay means.

5. The display apparatus according to claim 2, wherein there is provided display means that displays each color signal delayed by the plurality of delay means.

6. The display apparatus according to claim 1, wherein the phase detection means detects a phase of each color signal output from the plurality of delay means, and the control means performs control such that there is zero phase difference in outputs from each delay circuit.

7. The display apparatus according to claim 6, wherein the delay means comprises analog delay means having a delay amount of less than one pixel and digital delay means having a delay amount of one pixel or more, and the control means performs analog control of the analog delay means and performs digital control in one pixel units of the digital control means.

8. The display apparatus according to claim 7, wherein analog color signals delayed by the analog delay means are converted into digital color signals by A/D conversion means, and are then digitally delayed by the digital delay means, and the A/D conversion means samples each of the plurality of color signals using dot clocks supplied from the control means, and the control means divides the dot clocks into a predetermined number of divisions, then performs phase control on the dot clocks and then supplies them to the digital delay means, and also performs analog control of the analog delay means in a delay amount corresponding to the divided phases.

9. The display apparatus according to claim 7, wherein there is provided display means that displays each color signal delayed by the plurality of delay means.

10. The display apparatus according to claim 9, wherein the plurality of color signals are R, G, B signals.

11. The display apparatus according to claim 10, wherein the reference signal is a horizontal synchronization signal.

12. The display apparatus according to claim 6, wherein there is provided display means that displays each color signal delayed by the plurality of delay means.

13. The display apparatus according to claim 1, wherein analog color signals delayed by the analog delay means are converted into digital color signals by A/D conversion means, and are then digitally delayed by the digital delay means, and the A/D conversion means samples each of the plurality of color signals using dot clocks supplied from the control means, and the control means divides the dot clocks into a predetermined number of divisions, then performs phase control on the dot clocks and then supplies them to the digital delay means, and also performs analog control of the analog delay means in a delay amount corresponding to the divided phases.

14. The display apparatus according to claim 1, wherein there is provided display means that displays each color signal delayed by the plurality of delay means.

15. The display apparatus according to claim 1, wherein there is provided display means that displays each color signal delayed by the plurality of delay means.

16. The display apparatus according to claim 1, wherein the plurality of color signals are R, G, B signals.

17. The display apparatus according to claim 1, wherein the reference signal is a horizontal synchronization signal.

* * * * *